US006029586A

United States Patent [19]

Schiavello

[11] Patent Number: 6,029,586

[45] Date of Patent: Feb. 29, 2000

[54] DESKS, TABLES AND WORKSTATIONS

[75] Inventor: Antonino Schiavello, Templestowe, Wash.

[73] Assignee: Schiavello Commercial Interiors (Vic) Pty Ltd, Tullamarine, Australia

[21] Appl. No.: 08/812,578

[22] Filed: Mar. 7, 1997

[30] Foreign Application Priority Data

| | | | |
|---|---|---|---|
| Mar. 7, 1996 | [SG] | Singapore | 9601442 |
| Mar. 8, 1996 | [AU] | Australia | PN 8582 |
| Jul. 26, 1996 | [AU] | Australia | PO 1297 |

[51] Int. Cl.[7] ..... A47B 9/00

[52] U.S. Cl. ..... 108/147; 108/144.11

[58] Field of Search ..... 248/188.4, 423, 248/157, 161, 346.3, 354.4; 312/351.3, 257.1; 108/50.02, 147, 144.11

[56] References Cited

U.S. PATENT DOCUMENTS

| | | |
|---|---|---|
| D. 284,434 | 7/1986 | Boundy . |
| D. 288,750 | 3/1987 | Friedman . |
| D. 295,004 | 4/1988 | Schulz et al. . |
| D. 308,922 | 7/1990 | Ng et al. . |
| D. 314,105 | 1/1991 | Vossoughi . |
| D. 314,299 | 2/1991 | Diffrient . |
| D. 316,644 | 5/1991 | Diffrient . |
| D. 318,269 | 7/1991 | Hassel et al. . |
| D. 320,709 | 10/1991 | Lotsch et al. . |
| D. 326,575 | 6/1992 | Grosfillex . |
| D. 330,302 | 10/1992 | Heidmann . |
| D. 330,644 | 11/1992 | Bellini et al. . |
| D. 332,887 | 2/1993 | Fjello-Jensen . |
| D. 338,577 | 8/1993 | Vonhausen . |
| D. 352,406 | 11/1994 | Scheffers . |
| D. 355,787 | 2/1995 | Hollington . |
| D. 367,193 | 2/1996 | Dame et al. . |
| D. 367,379 | 2/1996 | Nicholson et al. . |
| D. 370,579 | 6/1996 | Simon . |
| 1,783,661 | 12/1930 | Makoski et al. . |
| 2,368,748 | 2/1945 | Doty . |
| 3,210,846 | 10/1965 | Balkin . |
| 3,253,284 | 5/1966 | St. John . |
| 4,515,414 | 5/1985 | Werth, Jr. . |
| 4,593,874 | 6/1986 | Dunagan . |
| 4,702,621 | 10/1987 | Heinonen et al. . |
| 4,940,339 | 7/1990 | Amano . |
| 4,957,376 | 9/1990 | Ward, Jr. . |
| 5,022,327 | 6/1991 | Solomon . |
| 5,031,869 | 7/1991 | Strater et al. . |
| 5,758,586 | 6/1998 | Kieser et al. ..... 108/144.11 |

FOREIGN PATENT DOCUMENTS

| | | |
|---|---|---|
| 246818 | 10/1962 | Australia . |
| B-51615/85 | 6/1986 | Australia . |
| B-43798/89 | 12/1992 | Australia . |

OTHER PUBLICATIONS

Newtech Corner Workstation Modules (2 pgs.) No date avail.

*Primary Examiner*—Peter M. Cuomo
*Assistant Examiner*—Gerald A. Anderson
*Attorney, Agent, or Firm*—Christensen O'Connor Johnson & Kindness PLLC

[57] ABSTRACT

A desk, table or workstation having a worktop member is provided with an incremental height adjustment system comprising at least one height adjustable leg having an upper leg part fixed to the worktop member, a lower leg part and one or more removable intermediate leg parts. The or each leg is disposed adjacent to a rear or side edge of the desk, table or workstation with the worktop member supported in a cantilever arrangement from the leg or legs. A vertically extending cable duct is attached to the lower leg part and for a desk, table or workstation having a plurality of legs, a cable tray is provided extending horizontally between adjacent legs. A hinged duct cover is also provided to cover the duct and cable tray.

31 Claims, 12 Drawing Sheets

G
66
60
70
30
80
20
G 68
64
66
64
70
67
60
71
E
77
62
E
74
74

66
67
62
60
74
60
77
64
66
64
71

74
70
68
64
77
70
30'

71

DESKS, TABLES AND WORKSTATIONS

BACKGROUND OF THE INVENTION

This invention relates to height adjustable desks, tables, workstations and like articles of office furniture.

One known type of desk height adjustment system for a desk top member is disclosed in Australian Patent No. 632297 and comprises two or more leg members each having a first leg part fixed to the desk top member and a second leg part movable vertically relative to the first leg part to adjust the height of the desk top member relative to the leg. The first part of each leg has a rotatable vertically extending screw with a bevel gear at its upper end and the second part of each leg includes a nut engaged with the rotatable screw of the first leg part. A horizontal rotatable shaft extends between pairs of leg members and a bevel gear is provided at each end of the shaft engageable with the bevel gear of a respective rotatable screw. A drive mechanism including a right-angle gearbox is provided for rotating the shaft to adjust the height of the legs simultaneously. The shaft may be rotated manually by a handle or by electric drive means.

Whilst such a desk height adjustment system operates efficiently to raise or lower the height of the desk top, it is expensive to manufacture. It is therefore desirable to provide a less expensive height adjustment system for desks workstations and the like that is relatively simple to assemble and operate.

With the increasing amount of electrical, computer and communications equipment used in office nowadays, it is also desirable to provide desks and workstations with means for concealing unsightly cabling required for the electrical, computer and/or communications equipment. This can be a particular problem in height adjustable desks and workstations which have adjustable legs with relatively moveable parts.

SUMMARY OF THE INVENTION

According to a first aspect of the invention, there is provided a height adjustable leg for a desk, table, workstation or the like having a top member wherein said leg comprises an upper leg part adapted to be fixed relative to the top member, a lower leg part, and one or more removable intermediate leg parts adapted to be received between the upper and lower leg parts, whereby the height of the upper leg part relative to the lower leg part can be varied incrementally by the removal, interchange or addition of at least one intermediate leg part.

Preferably, the upper and lower leg parts are connected by an elongate adjustable member which attends through the intermediate leg parts. The adjustable member preferably has upper and lower portions adapted to engage the upper and lower leg parts, or members secured thereto, to retain the intermediate leg parts securely in position. In a preferred embodiment, the adjustable member comprises a rod having a head and an elongate shaft, a lower end portion of which is provided with a screw-thread for engagement wit a threaded aperture in the lower leg part or a lower member secured thereto- The adjustable member preferably has an upper portion adapted to be engaged by an adjustment tool for rotating the shaft relative to the lower leg part. The screw-threaded member may be loosened to allow intermediate leg parts to be removed or added to decrease or increase the height of the upper leg part relative to the lower leg part, and then tightened to retain the intermediate leg parts securely in position in a rigid and secure adjustable leg assembly.

Conveniently, a plurality of intermediate leg parts of substantially the same dimensions may be provided so that the height of the adjustable leg assembly depends upon the number of intermediate leg parts used in the leg assembly. Alternatively, or additionally, it is envisaged that intermediate leg parts of different sizes may be provided so that the height of the adjustable leg assembly may be increased or decreased by the interchange of one intermediate leg part for another leg part of greater or lesser size.

The intermediate leg parts preferably have vertical slots provided therein through which the shaft of the adjustable member extends to facilitate removal or addition of the intermediate leg parts.

In a particularly preferred embodiment, the head of the adjustable rod is engageable with the upper leg part and an upper portion of the shaft extends through apertures in the upper leg part and a top member secured to the upper leg part. The upper portion of the shaft extending through the top member is conveniently of non-circular, e.g. hexagonal, cross-section, so that it can be engaged by a spanner or other adjustment tool, and the top member has a recess in one of its sides to allow the upper portion to be engaged by the adjustment tool.

According to another aspect of the invention, there is provided a height adjustment system for a desk, table, workstation or the like comprising a worktop member supported by at least one height adjustable leg in accordance with the first aspect of the invention.

In accordance with a particularly preferred feature of the invention, a height adjustable leg of the height adjustment system includes a duct for cabling. The duct for cabling is preferably attached to the lower part of the leg so that when the upper leg part is moved to adjust the height of the worktop member, the duct and cabling therein does not move.

Such a duct for cabling may be incorporated within any type of desk, table, workstation or the like. According to a further aspect of the invention, there is provided a desk, table, workstation or the like having a top member, wherein said leg comprises an upper leg part adapted to be fixed relative to the top member, and a lower leg part, wherein the leg includes a duct for cabling attached to one of the leg parts.

The desk, table or workstation may include a height adjustment means for adjusting the height of the upper leg part relative to the lower leg part such as an incremental adjustment means as described in accordance with the first aspect of the invention, comprising an elongate adjustable member connecting the upper and lower leg parts and extending through a plurality of removable intermediate leg parts.

In an alternative embodiment of the further aspect of the invention, the means for adjusting the height of the upper leg part relative to the lower leg part may comprise a vertically extending screw which is rotatable to cause the upper leg part and top member to move substantially vertically relative to the lower leg part. The lower part of the leg may have a nut engaged with the lower end of the screw, and the upper end of the screw preferably has a bevel gear at its upper end engageable with a bevel gear on a horizontally extending rotatable shaft. The horizontally extending shaft may extend between pairs of height adjustable legs with a bevel gear provided at each end of the horizontal shaft engageable with the bevel gear of a respective rotatable screw of each leg member. In this manner, the height of two or more legs of a desk or workstation may be adjusted simultaneously by rotating the horizontal shaft by a drive mechanism. The shaft may be rotated manually by a handle or by electric drive means.

A desk, table or workstation having a plurality of legs is preferably provided with at least one cable tray for receiving one or more cables and extending substantially horizontally between ducts attached to the legs The cable tray is preferably secured to the upper ends of ducts attached to the lower leg parts of the legs. The duct and/or the cable tray is preferably divided into at least two compartments by partition means. One of the compartments may be provided for electricity cables with another of the compartments being provided for telecommunications cabling or computer cables.

In a particularly preferred embodiment, the duct and/or cable tray may include a power or communications socket of an electrical wiring system. The power or communications outlet socket is preferably provided at the top of the duct cable tray below the height of the top member of the desk, table or workstation so that electrical, computer or telecommunications appliances can be readily connected to power or communications cables received by the duct or cable tray.

In accordance with a further preferred feature of the invention, a top member of a desk, table or workstation of the invention is provided with a duct or cable tray cover member. Preferably, the duct or cable tray cover member is connected to the top member in such a manner as to be movable from a first position in which the cover member extends substantially horizontally level with the top member and a second position which allows access to the cable duct or tray and any cables or outlet sockets the duct or tray may have.

According to yet another aspect of the invention, there is provided a desk, table, workstation or the like having at least one leg supporting a substantially horizontal top member, a cable duct or tray attached to a part of the leg or legs, and a duct or tray cover member connected to the top member and movable from a first position covering the duct or tray to a second position allowing access to the duct or tray.

In a particularly preferred embodiment, the cover member is pivotally connected to an edge of the top member, and is pivotally movable through approximately 180° from the first position to a position in which the cover member lies substantially horizontally on the top member.

In accordance with another aspect of the invention, a desk, table, workstation or the like has a plurality of legs provided adjacent to a side or rear edge of a top member of the desk, table or workstation, with the top member being supported in a cantilever arrangement from support beams extending between the legs of the system. This feature is particularly desirable when a cable duct or tray is to be connected to the leg or legs.

In a preferred cantilever support arrangement in accordance with the invention, the support beams are clamped between upper and lower clamping members, with the upper clamping members being secured to the worktop. The lower clamping members may comprise, or be secured to, upper parts of the legs of the desk or workstation. Alternatively, or additionally, the upper and lower clamping members may be provided to clamp the support beams at locations between the legs.

When the system includes a plurality of legs, a pair of support beams are preferably provided extending substantially horizontally between adjacent legs.

Preferably a pair of spaced apart support beams extend between adjacent legs of the desk or workstation. The support beams are preferably disposed at substantially the same horizontal level and extend substantially parallel to each other between adjacent legs.

The upper and lower clamping members may be secured together with a support beam clamped therebetween by any convenient securing means. Preferably strong bolts, such as coach bolts are used to secure the clamping members to each other. The support beams are preferably formed from a strong metallic material, such as roll-formed steel.

In accordance with a particularly preferred feature of the invention the upper and lower clamping members have projections and/or recesses which engage with complementary recesses and/or projections in the support beams. This arrangement of the spaced apart support beams, clamped between clamping members provided with projections and/or recesses engaging with complementary recesses and/or projections in the support beams results in a very strong cantilever support for a worktop in which torsional forces are minimised.

The upper and lower clamping members may comprise clamping plates having horizontal dimensions similar to the horizontal extent of the spaced apart support beams. Alternatively, the upper clamping member may comprise a cantilever support arm having a body part which is secured to the lower clamping members to clamp the beams and an arm portion extending in a substantially horizontal direction from the support beams.

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENTS

Figure 1:
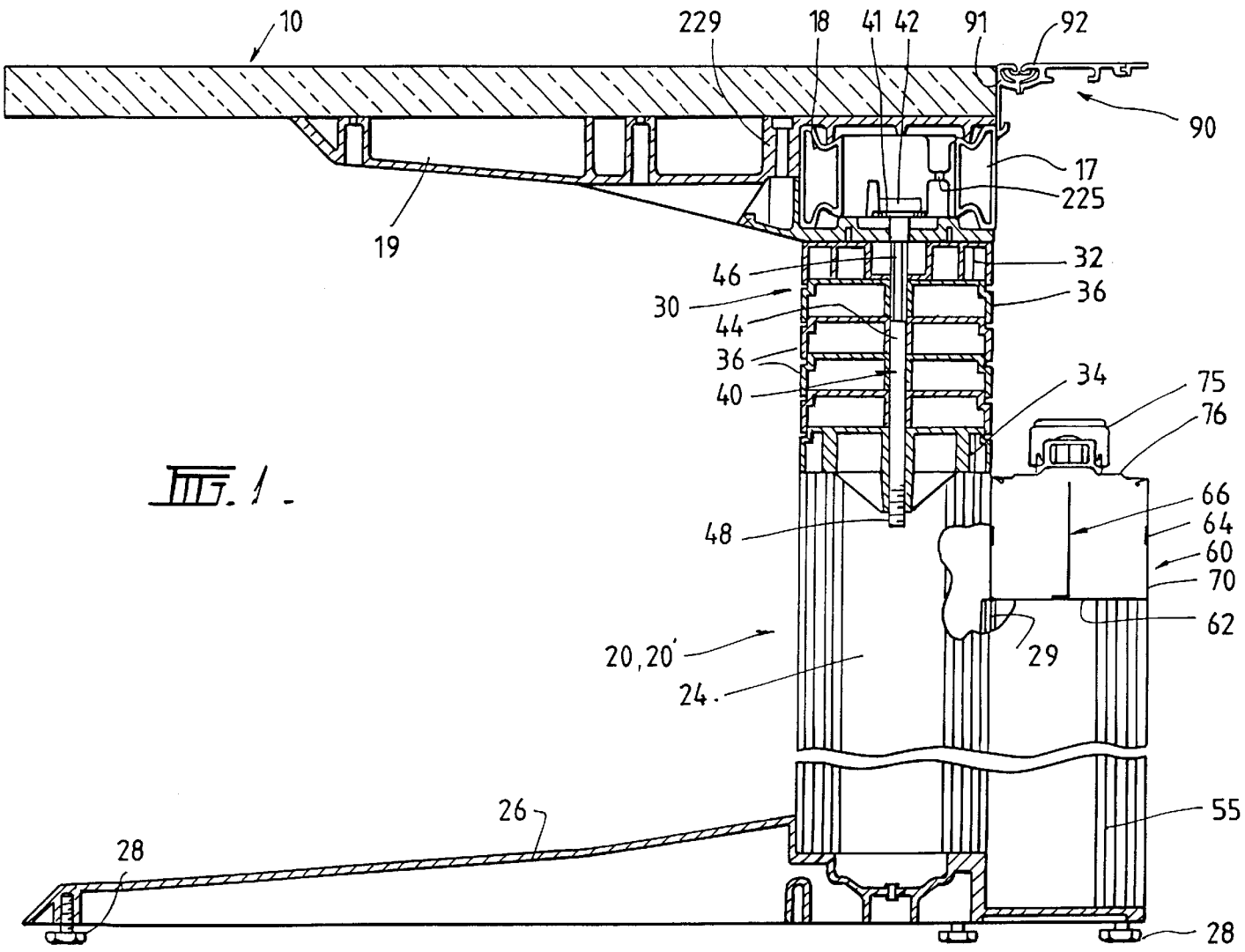
FIG. 1 is a section through a height adjustable leg for a desk or workstation in accordance with the invention.

The height adjustment system shown in the drawings comprises a member 10 of a desk or workstation having a plurality of height adjustable legs 20, 20' each incorporating a height adjustment mechanism 30.

Figure 2:
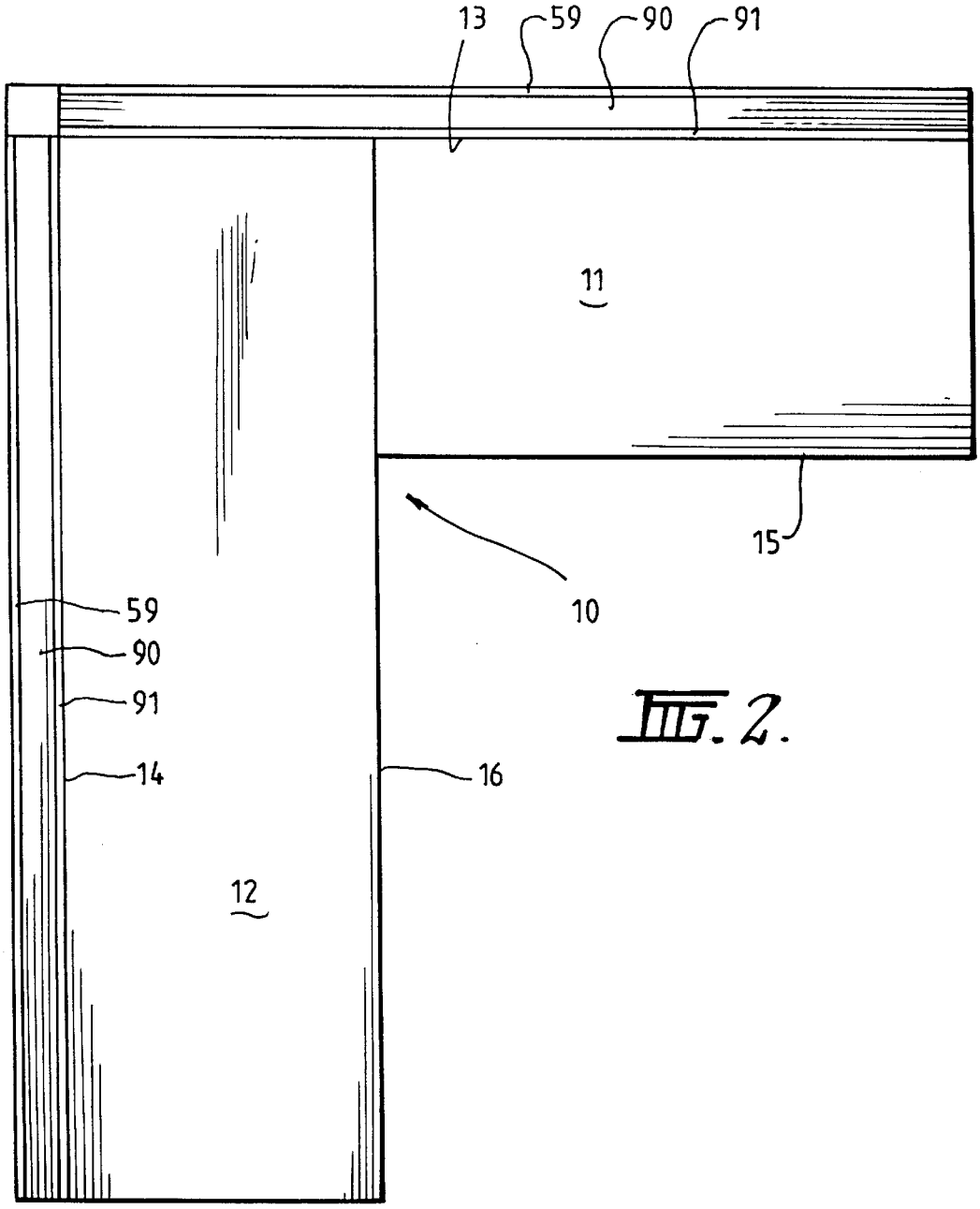
FIG. 2 is a top plan view of a desk which has a plurality of height adjustable legs of the kind shown in FIG. 1.
Figure 3:
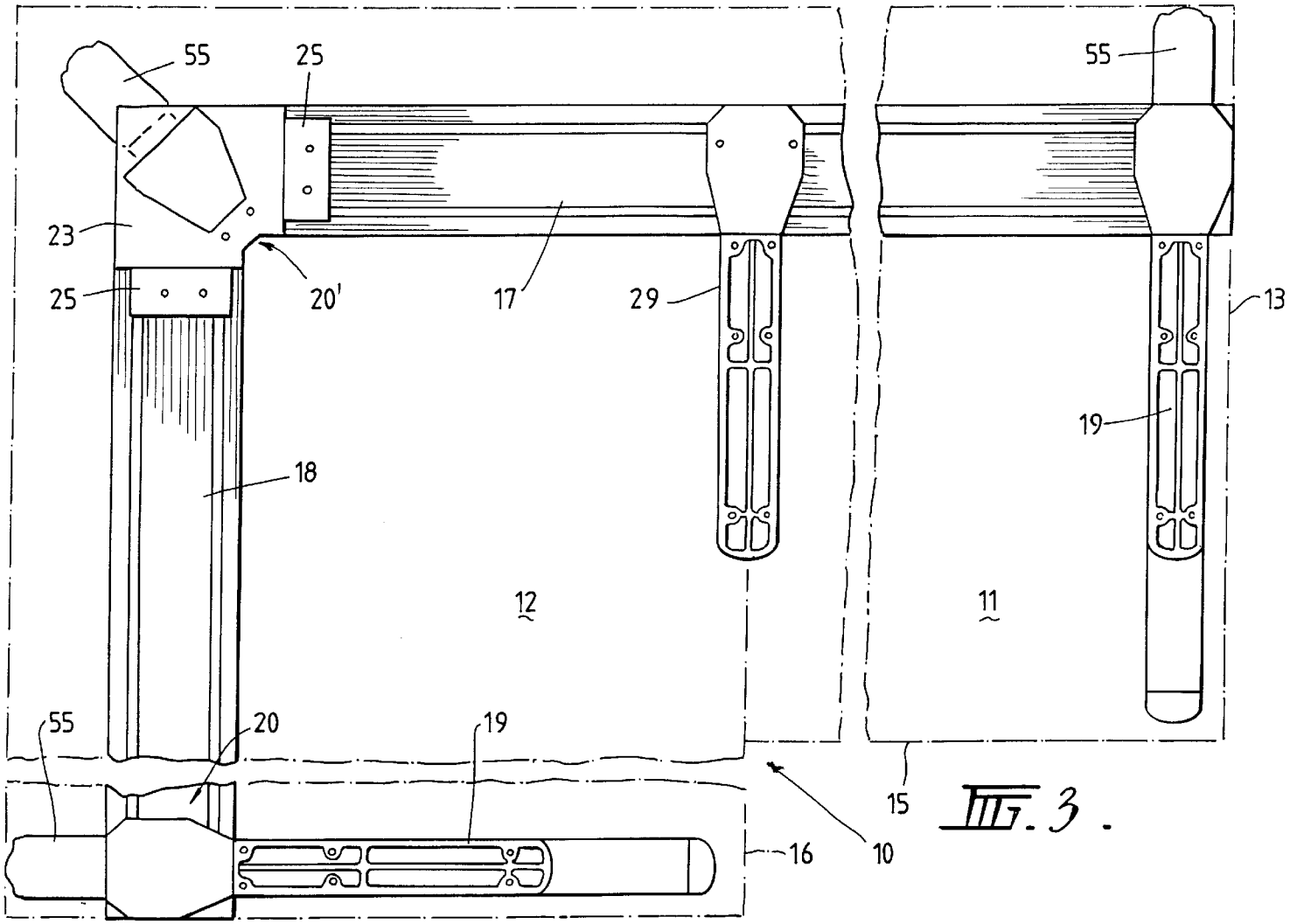
FIG. 3 is a plan view of the desk of FIG. 2 with the outline of the desk-top shown in broken lines.
Figure 4:
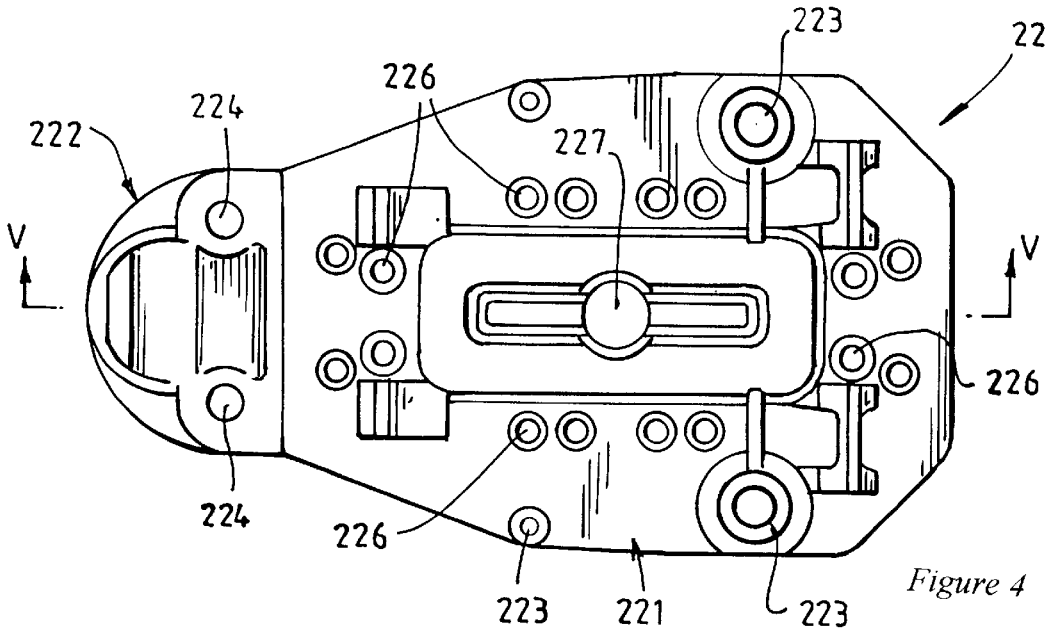
FIG. 4 is a top plan view of an upper leg part of the height adjustable leg of FIG. 1.
Figure 5:
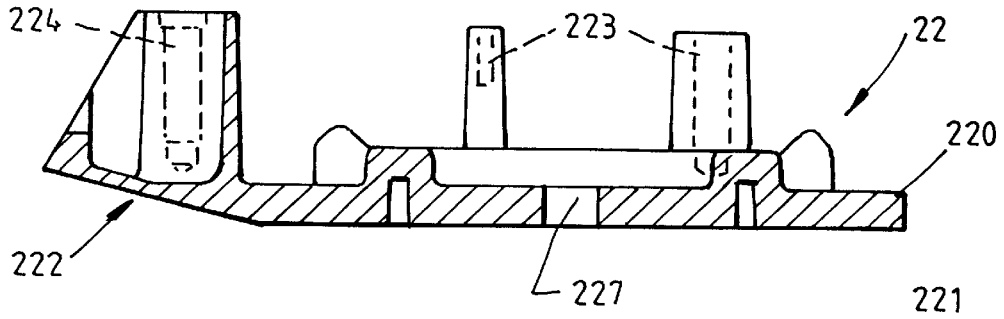
FIG. 5 is a section on the line V—V of FIG. 4.
Figure 6:
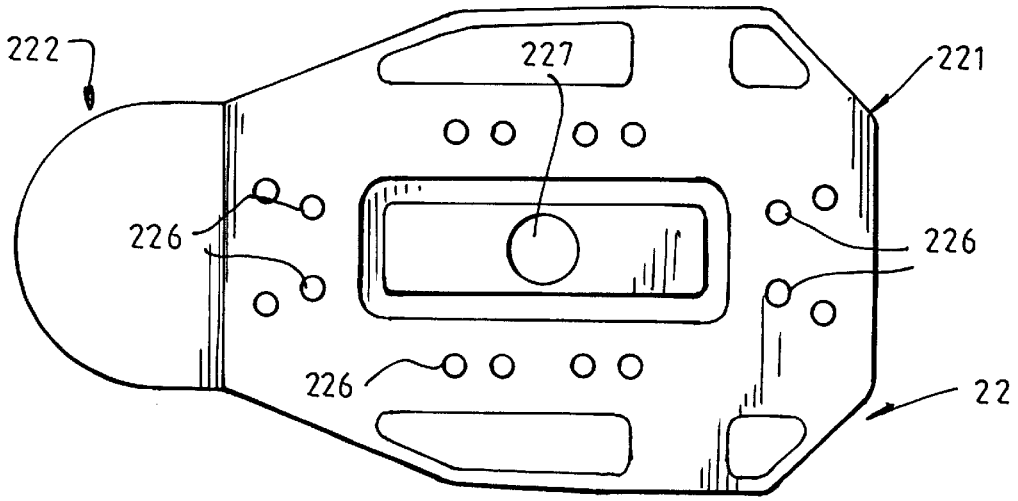
FIG. 6 is an underneath plan view of the upper leg part of FIG. 4.
Figure 7:
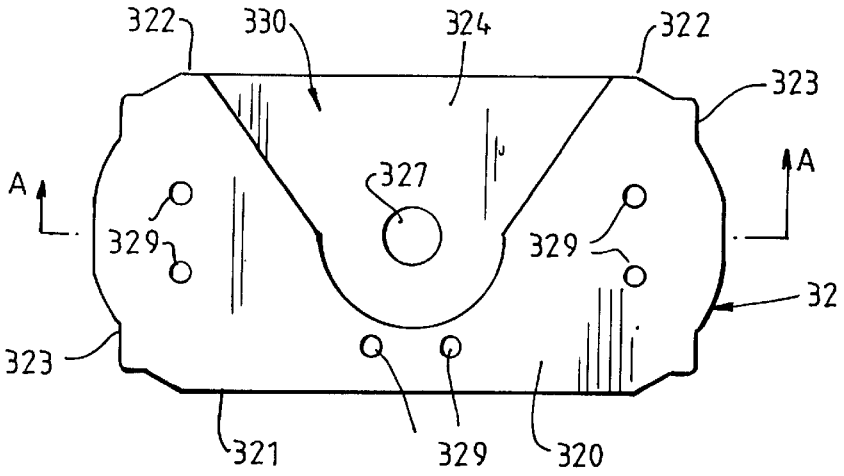
FIG. 7 is a top plan view of a top member of an incremental adjustment mechanism of the leg of FIG. 1.
Figure 8:
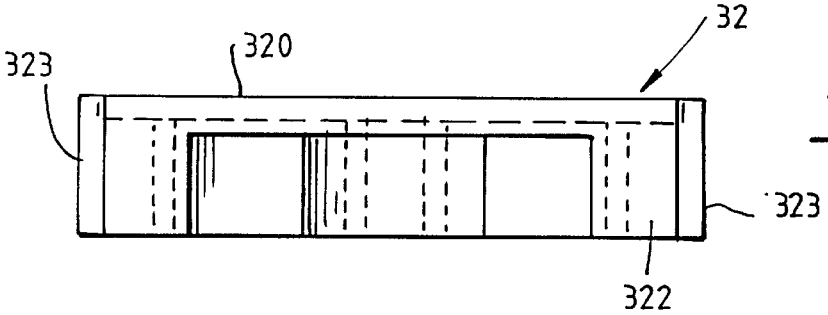
FIG. 8 is a side view of the top member of FIG. 7.
Figure 11:
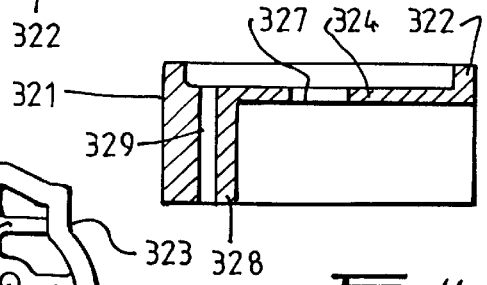
FIG. 11 is a section on the line B—B of FIG. 9.
Figure 9:
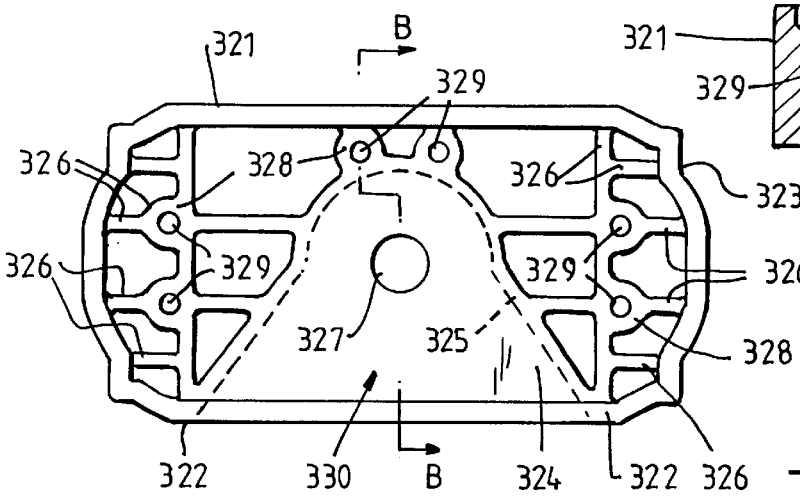
FIG. 9 is a underneath plan view of the top member.
Figure 10:
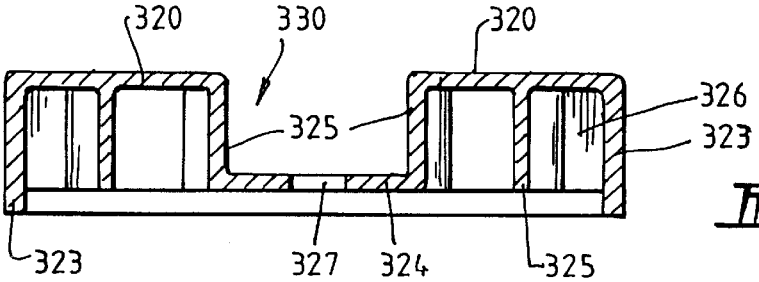
FIG. 10 is a section on the line A—A of FIG. 7.
Figure 12:
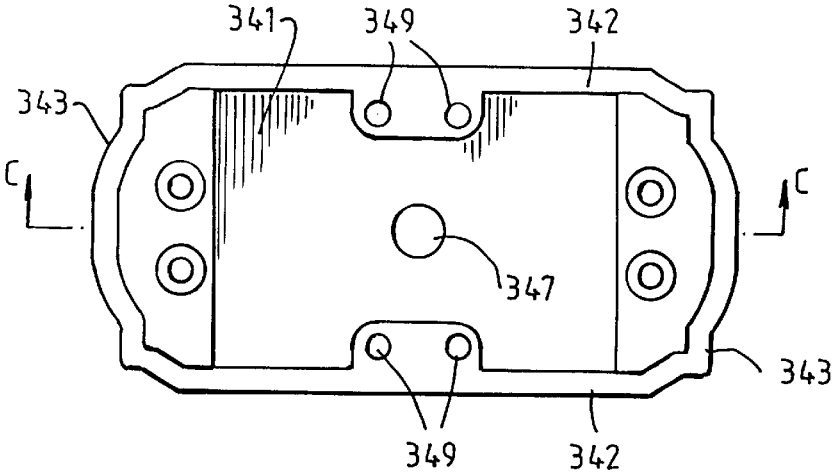
FIG. 12 is a top plan view of a bottom member of the incremental adjustment mechanism.
Figure 13:
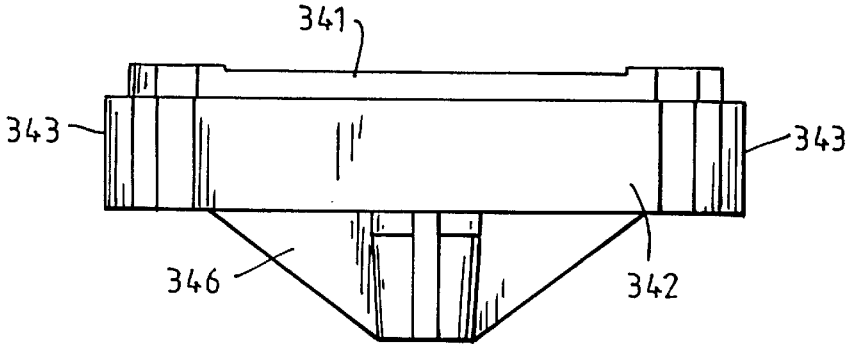
FIG. 13 is a side view of the bottom member of FIG. 12.
Figure 14:
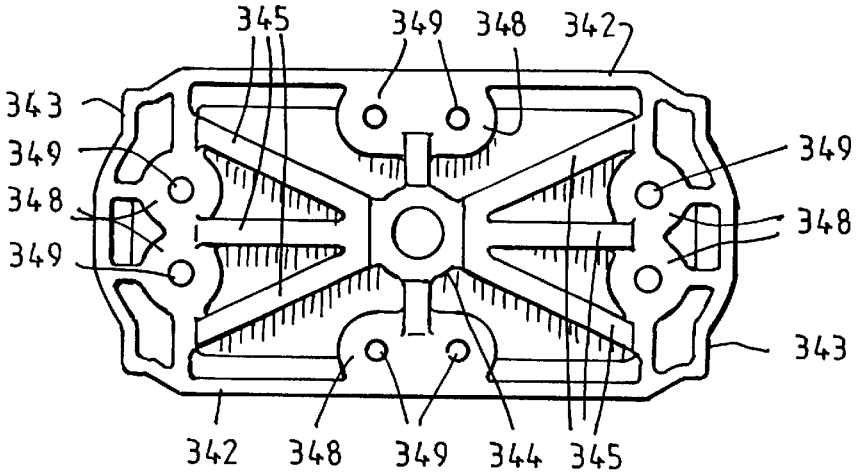
FIG. 14 an underneath plan view of the bottom member.
Figure 15:
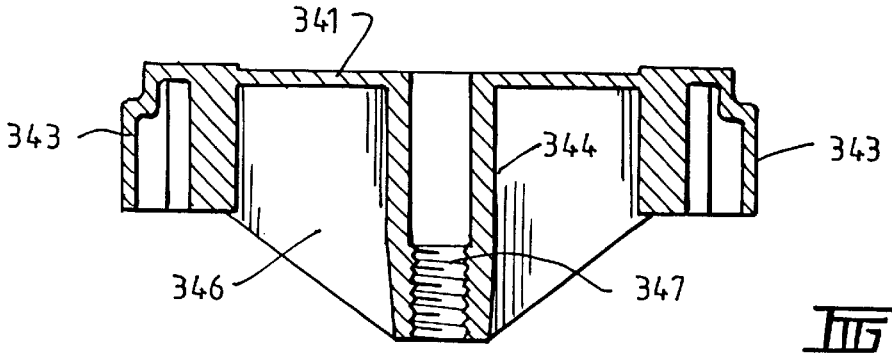
FIG. 15 is a section on the line C—C of FIG. 12.
Figure 16:
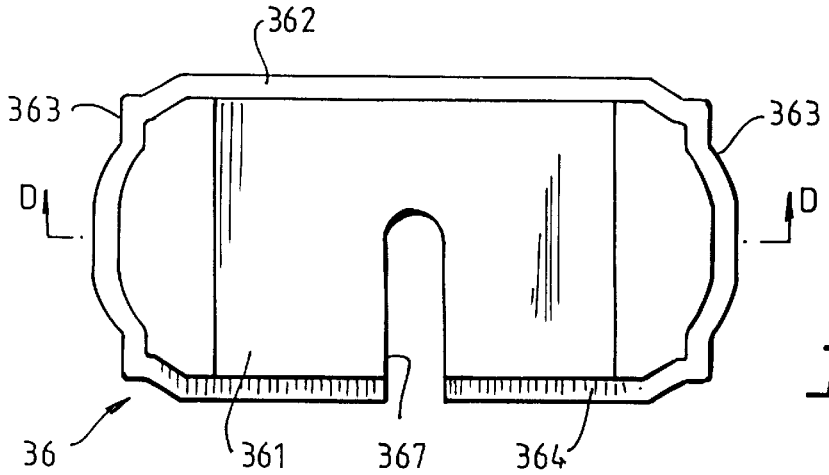
FIG. 16 is a top plan view of an intermediate member of the incremental adjustment mechanism.
Figure 17:
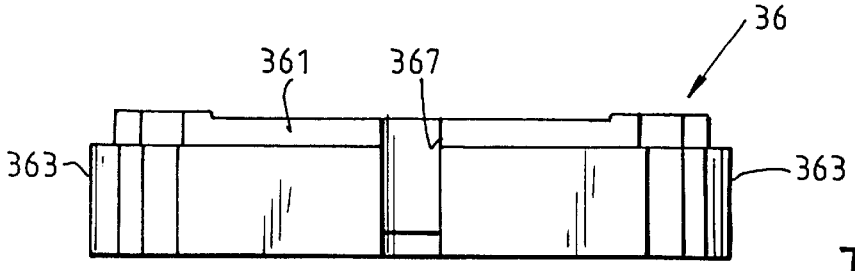
FIG. 17 is a side view of the intermediate member of FIG. 16.
Figure 18:
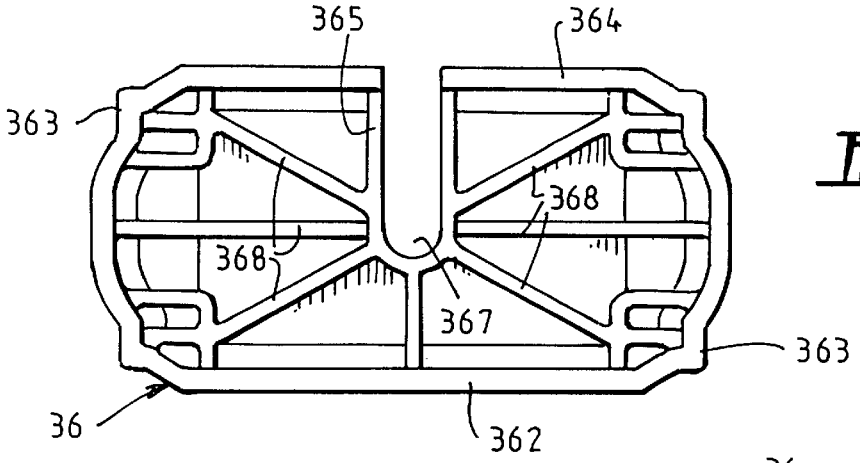
FIG. 18 is an underneath plan view of the intermediate member of FIG. 16.
Figure 19:
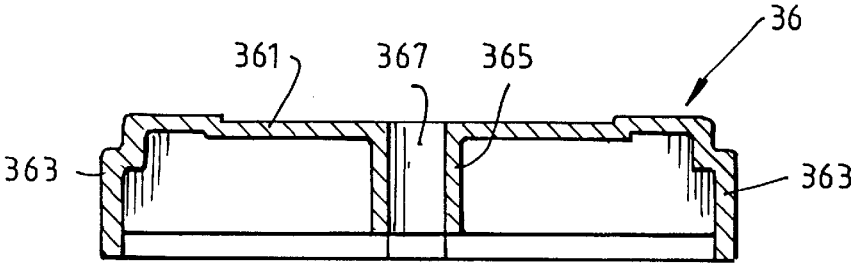
FIG. 19 is a section on the line D—D of FIG. 16.

The top member 10 shown in FIGS. 2 and 3 is substantially L-shaped having first and second limbs 11 and 12 extending in perpendicular directions.

As shown in FIG. 3, a height adjustable leg 20 is provided at the ends of each limb 11, 12 and another height adjustable leg 20' is provided at the corner of the top member 10. The legs 20, 20' are located at the rear or outer edges 13, 14 of the top member 10 in order to provide maximum leg room under the top member and the top member 10 is supported by cantilever support arms 19 mounted on and extending from roll-formed steel beams 17, 18 extending between the legs 20 and 20'. The cantilever support arms 19 preferably extend from the upper ends of the legs 20, 20' and, if required at least one additional cantilever support arm 29 may be provided at a position or positions between the corner leg 20' and the legs 20.

FIG. 1 shows one of the legs 20 in section. The leg 20 has a first upper leg part 22 adapted to be fixed relative to the top member 10, and a second, lower leg part 24. The height of the upper leg part 22 is incrementally adjustable relative to the lower leg part 24 by means of the height adjustment mechanism 30.

The lower leg part 24 comprises a substantially vertically extending column and a generally horizontally extending foot 26 is secured to the lower end of the column 24. The foot 26 is provided with adjustable pads 28, each having a screw-threaded upright rod received in an internally threaded recess in the foot 26 so that the level of the foot 26 can be adjusted relative to the floor.

The upper leg part 22 comprises a metal plate casting 220 having a main body portion 221 and a forward extension portion 222. The main body portion 221 and forward extension portion 222 each have tubular screw-receiving portions 223 and 224 extending upwardly from the upper surface of the plate adapted to receive screws 225 for fixing the upper leg part to a cantilever support arm 19. The support arm 19 is provided with complementary formations 228, 229 with apertures extending therethrough for receiving the fixing screws 225. The steel beams 17, 18 are disposed between the main body part 21 of the upper leg part 22 and the support arm 19 so as to be mounted therebetween. The main body portion 221 of upper leg part 22 is also provided with a plurality of screw-receiving apertures 226 and a larger central opening 227 extending through the plate casting 220.

As shown in FIG. 3, the corner leg 20' is not provided with a cantilever support arm. Instead, a corner member 23 in the form of a metal casting is secured to the top member 10 and to the upper part 22' of the leg 20', with corner clamps 25 being provided for mounting the support beams 17, 18 to the corner leg 20'.

The height adjustment mechanism 30 comprises a top starter member 32 fixed to the upper leg part 22, a bottom starter member 34 fixed to the lower leg part 24, a number of removable intermediate members 36, and an adjustable rod 40 for securing the intermediate members 36 between the top and bottom members 32 and 34.

The top starter member 32, bottom starter member 34 and intermediate members 36 have substantially the same cross-sectional shape as the vertical column 24 of the lower leg part being generally rectangular in cross-sectional shape. The top starter member 32 has an upper wall 320, a continuous side wall 321, an opposed side having side wall portions 322, end walls 323, a generally wedge-shaped central lower wall portion 324 joined to the upper wall 321 by vertical portions 325, and transversely and longitudinally extending vertical partitions 326. Thus, as shown in FIGS. 7 to 10, the side of the top starter member 32 between the side wall portions 322 has a substantially wedge-shaped recess 330 above the lower wall portion 324 defined by the vertical portions 325. A central opening 327 is provided in the lower wall portion 324, and tubular screw-receiving portions 328 having bores 329 extending therethrough are provided for receiving screws for sag the top starter member 32 to the lower surface of the upper leg part 22.

The bottom starter member 34 has an upper wall 341, side walls 342, end walls 343, a central tubular portion 344 extending downwardly from the upper wall 341 and longitudinally, transversely and diagonally extending partitions 345 extending downwardly from the upper wall 341 below the side walls to the central tubular portion 344 to form a tapered lower part 346. The central tubular portion 344 has a central bore 347, the lower part of which has an internal screw read, and a plurality of tubular screw-receiving portions 348 having apertures 349 extending therethrough are provided for receiving screws for securing the bottom starter member 34 onto the upper end of the vertical column 24.

Each intermediate member 36 has an upper wall 361, side walls 362, 364, end walls 363 and a U-shaped partition 365 which defines a vertical slot 367 in one of the side walls 364 which extends inwardly to the centre of the intermediate member terminating in a semi-circular rounded end. The intermediate member may also have strengthening ribs or walls 368 provided on the lower surface of the upper wall 361.

In the height adjustable leg shown in FIG. I there are four removable intermediate members 36 between the top and bottom starter members 32 and 34. The intermediate members are held securely in position by the elongate securing rod 40 which has an enlarged head 42 and a downwardly extending shaft 44 which extends vertically down through the openings 227, 327 in the upper leg part 22 and top starter member 32, through the slots 367 in the intermediate members 36 and into the central bore 347 of the bottom starter member 34.

The head 42 of the adjustable rod 40 is engageable with the upper surface of the upper leg part 22 with a steel washer 41 disposed therebetween.

The shaft 44 terminates in a lower screw-threaded end portion 48 which is threadably received in the internally screw-threaded part of the bore 347. The upper portion 46 of the shaft which extends through the top starter member 32 is hexagonal in cross-section and the wedge-shaped recess 33 in the side of the top starter member 32 between the side wall portions 322 allows an appropriate tool, such as a spanner, to be inserted from the side of the top starter member 32 to engage the hexagonal upper portion 46 to tighten or loosen the sag rod 40. When the rod 40 is loosened, one or more of the intermediate members 36 can be removed by sliding it horizontally out of the assembly in the direction of its slot 367 and the rod 40 subsequently tightened to reduce the height of the upper leg part 22 and top member 10 relative to the lower leg part 24. If the rod 40 is loosened to raise the top starter member 32 and upper leg part 22 by an amount greater than the height of an intermediate member 36, an additional intermediate member can be added to increase the height of the top member 10 relative to the lower leg part.

In accordance with a further advantageous feature of the invention, the desk height adjustment system is provided with a cable duct and tray system as will now be described with reference to FIGS. 1 and 20 to 33.

Figures 20, 21, 22, 23, 24, 25, 26:
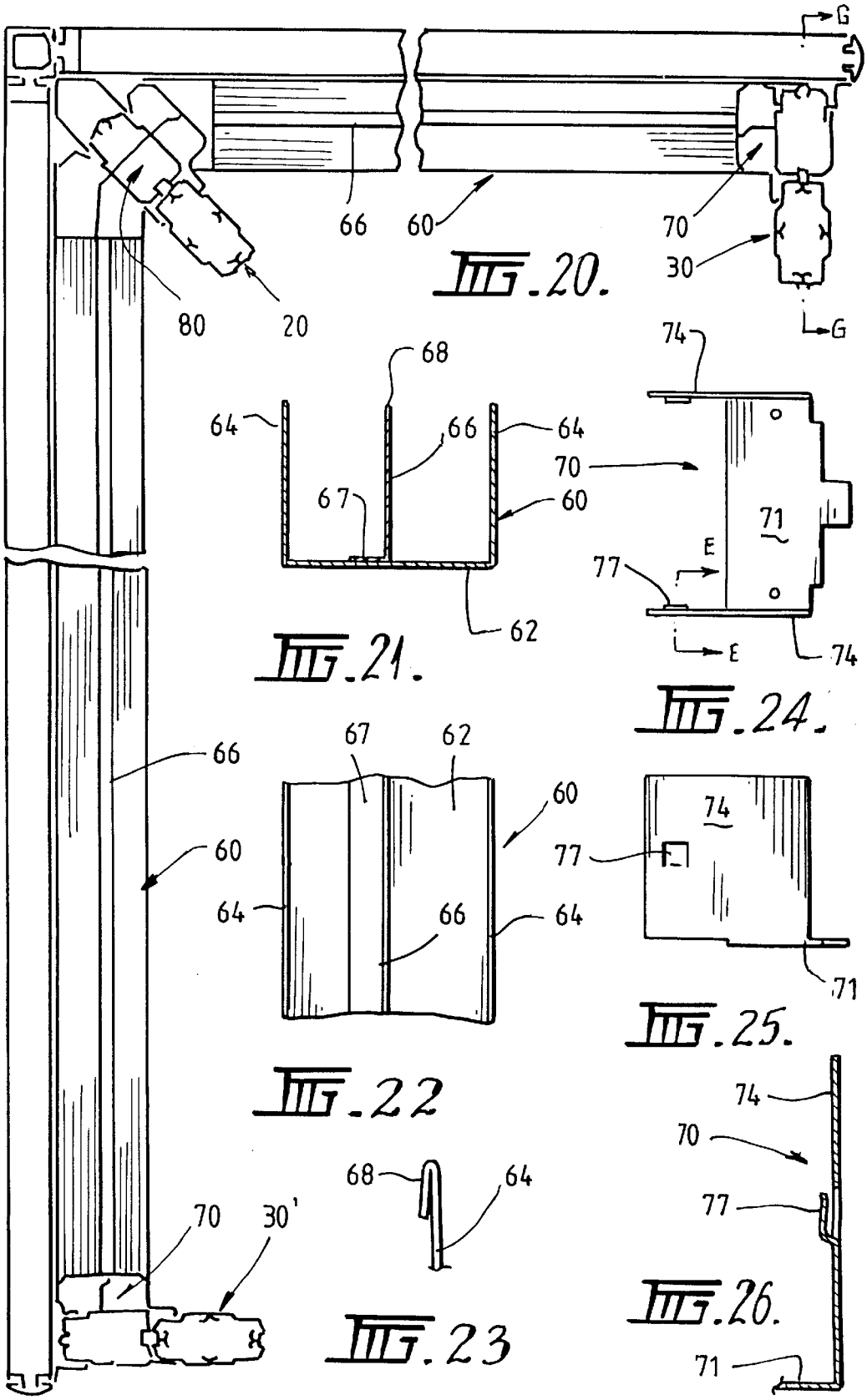
FIG. 20 is a plan view of a cable tray and duct assembly for the desk of FIGS. 2 and 3.
FIG. 21 is a section through the cable tray of the assembly of FIG. 20.
FIG. 22 is a plan view of part of the cable tray.
FIG. 23 is an enlarged detail of an end portion of the wall of the cable tray.
FIG. 24 is a plan view of an end connection piece of the cable tray assembly.
FIG. 25 is a side view of the end piece of FIG. 24.
FIG. 26 is an enlarged section on the line E—E of FIG. 24.
Figure 27:
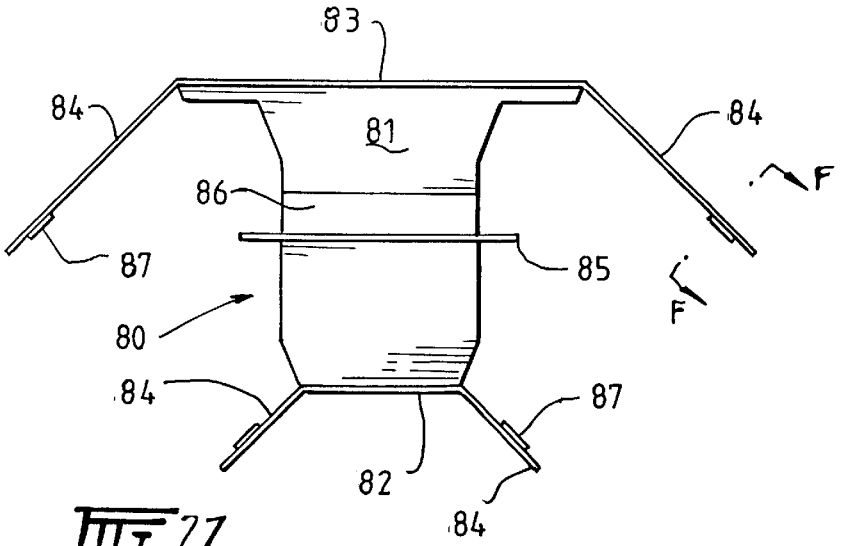
FIG. 27 is a plan view of a corner connection piece of the cable tray assembly.

As shown in FIGS. 1, 20 and 27, a vertically extending expansion duct 55 is attached to the lower part 24 of each leg 20, 20' and a horizontally extending cable tray 60 for electrical, computer and/or communications cable extends between the corner leg 20' and each of the end legs 20. Each cable tray 60 comprises a generally U-shaped channel having a base 62 and two side walls 64. Each tray 60 is also provided with a partition 66 extending longitudinally along its length which divides the tray into two compartments. The partition 66 may conveniently be formed from an L-shaped metal member having a shorter limb 67 welded to the base and a longer limb 68 extending upwards from the base 62.

The ends of the cable trays 60 are supported by connection pieces 70, 80 mounted on the upper ends of the expansion ducts 55. As shown in FIGS. 24 to 26 each end connection piece 70 has a base plate 71 and a pair of side plates 74 extending upwardly from the base plate 71.

Figure 29:
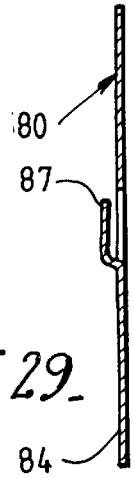
FIG. 29 is an enlarged section on line F—F of FIG. 27.
Figure 28:
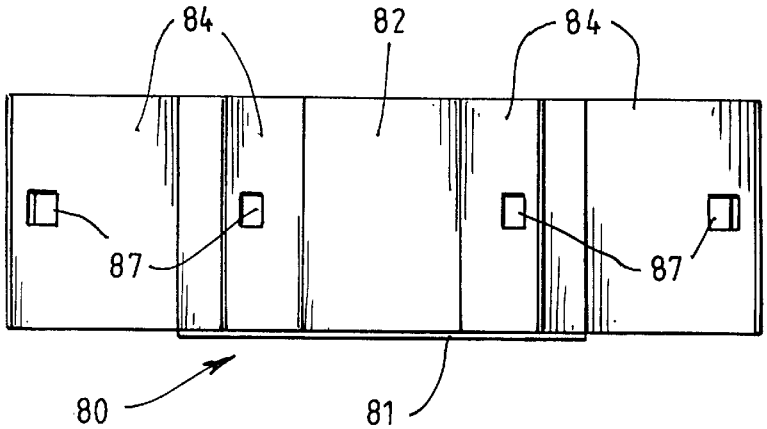
FIG. 28 is a front view of the corner piece of FIG. 27.

The corner connection piece 80 shown in FIGS. 27 to 29 has a base plate 81, front and rear walls 82, 83 and a side plate 84 at each side of the front and rear walls 82, 83 extending at an angle of approximately 45° to the front and rear walls 82, 83. The corner connection piece 80 may have a central dividing plate 85 similar to the partition 68 extending upwardly from its base plate 81. The base plate 71, 81 of each connection piece may be attached to the upper surface of the expansion duct 55 of a respective leg 20, 20' in any convenient manner, for instance by spot welding.

Each of the side plates 74, 84 of the connection pieces 71, 81 is provided with a duct mounting element 77, 87 for engaging and supporting an end of a respective cable duct 60. As shown in FIGS. 26 and 29, the duct mounting element 77, 87 of each side plate 74, 84 comprises a tab formed by cutting out three sides of a square from the side plate 74, 84 leaving the lowest side of the square joined to the side plate. Each tab 77, 87 is adapted to be engaged by a hook-like formation 68 such as shown in FIG. 23 provided on the upper edge of an end portion of a respective one of the side walls 64 of the cable tray 60, thus supporting the cable trays 60 between the connection pieces 70, 80 on the expansion ducts 55 of the legs 20, 20'.

Figure 30:
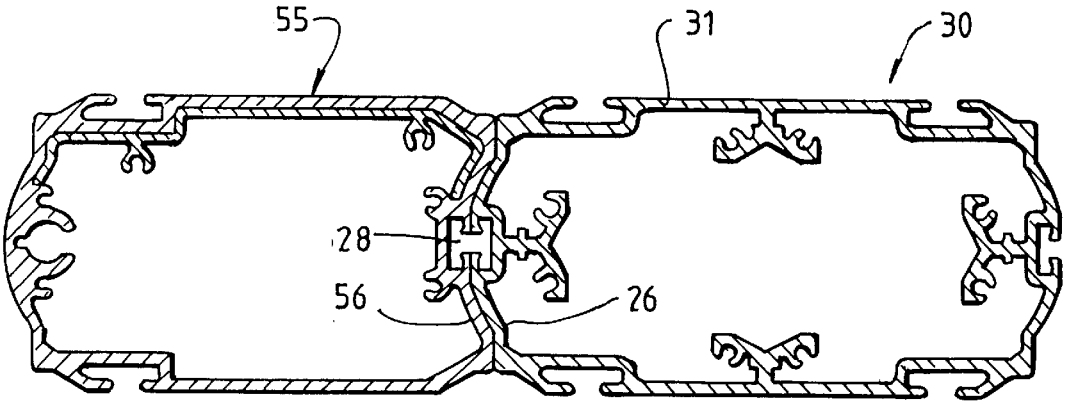
FIG. 30 is an enlarged section on the line G—G of FIG. 20.

As shown in FIG. 30, the expansion duct 55 is of hollow form. Preferably the base plate 71, 81 of a connection piece 70, 80 for at least one of the expansion ducts 55 does not extend across all of the upper end of its respective hollow expansion duct 55 so that, if required, one or more cables for electricity, computer or communications may be provided within the expansion duct 55.

As shown in FIG. 1, an outlet socket 75 may be mounted to the cable tray 60 at any convenient position by a mounting piece 76 adapted to clip onto the upper ends of the side plates 64 of the cable tray 60. The outlet socket 75 may be a power outlet socket of a modular wiring system such as that which is sold under the Trade Mark INTERPOWER in Australia. Alternatively, the outlet socket may be a computer or telecommunications socket, and it will be appreciated that different types of sockets for different purposes may be provided at different locations on the cable tray 60.

The expansion duct 55 may be attached to the column 24 of the lower leg part by any convenient means. For instance, side walls 56, 246 of a respective duct 55 and column 31 may define a generally H-shaped vertical channel 248 as shown in FIG. 30 which is adapted to receive a complementary H-shaped attachment member 249.

Referring to FIGS. 1, 2 and 31 to 33 a duct cover 90 is attached to the rear or outer edge 13, 14 of each limb 11, 12 of the desk-top member 10. Each duct cover 90 comprises an elongate strip which is hingedly attached to the desk-top member by a pivotal mounting comprising a cover mounting member 91 secured to the desk top member 10 and a pivot piece 92 received between retaining portions 93, 94 of the mounting member 92 and the duct cover 90.

The pivot piece 92 is generally E-shaped in cross-section having curved limbs 95 with enlarged heads 96 extending on either side of a central protuberance 97. The retaining portions 93, 94 of the duct cover 90 and mounting member 91 are of similar shape having upper and lower limbs 98, 99 defining a channel therebetween for receiving a respective one of the curved limbs 95 of the pivot piece 92.

Figure 31:
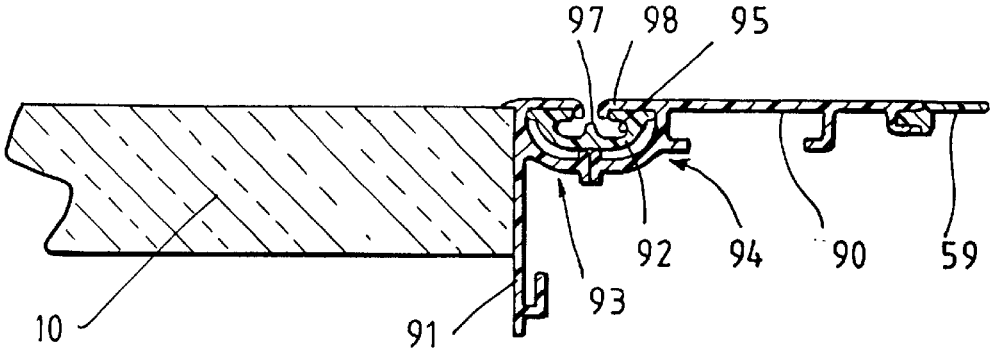
FIG. 31 is an enlarged section through a hinged duct cover of the desk in a closed position.
Figure 32:
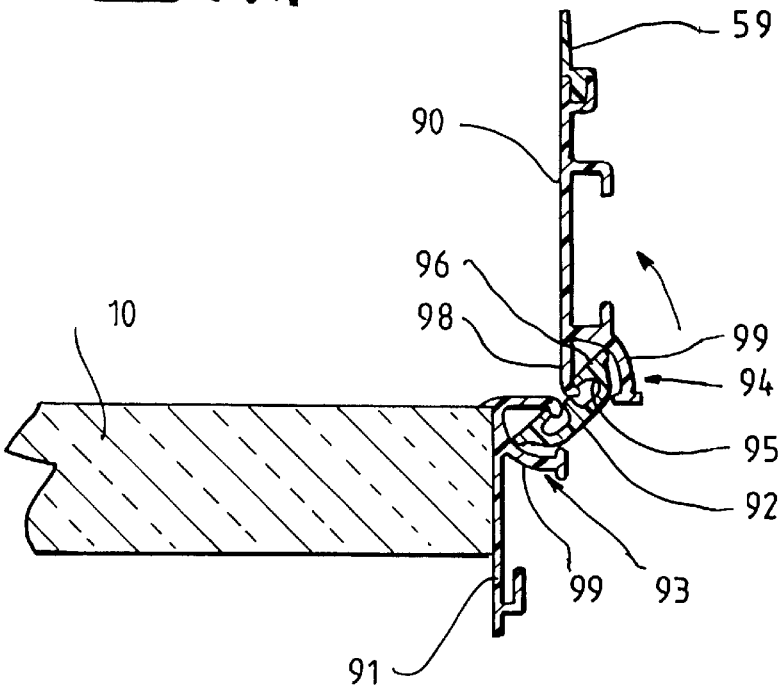
FIG. 32 is a section similar to FIG. 31 showing the duct cover in an immediate position.
Figure 33:
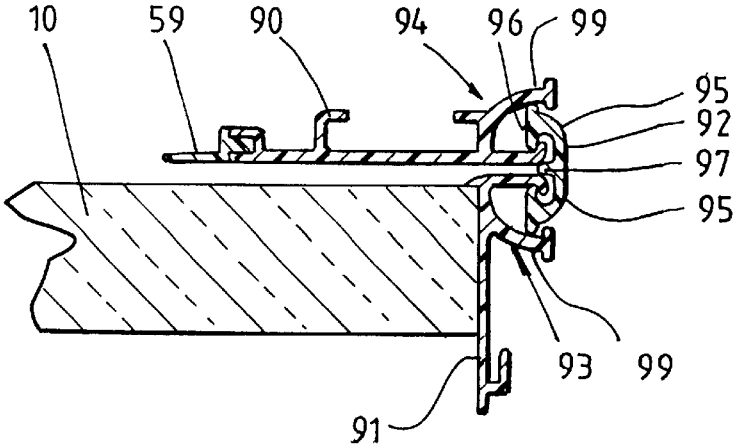
FIG. 33 is a section similar to FIG. 31 showing the duct cover in an open position.

It will be seen from FIGS. 31 to 33 that the arrangement of the duct cover 90, mounting member 91 and pivot piece 92 is such that the duct cover 90 is pivotally movable from a first closed position as shown in FIGS. 1 and 31 in which the duct cover extends horizontally at substantially the same level as the upper surface of the desk-top member 10 to cover the duct 55 and cable tray 60, through a vertical intermediate position as shown in FIG. 32, to a second, open position as shown in FIG. 33 in which the duct cover 90 extends substantially horizontally directly above the peripheral rear edge portion of the desk top member 10. The open position of the duct cover member 90 allows access to the duct 55, cable tray 60 and outlet socket(s) for connection or disconnection of electrical, computer and/or communications equipment.

The duct cover 90 and mounting member 91 are conveniently formed from aluminium extrusions, and a rubber seal 59 is preferably affixed to the edge of the duct cover remote from its pivot piece retaining portion 94.

Figure 34:
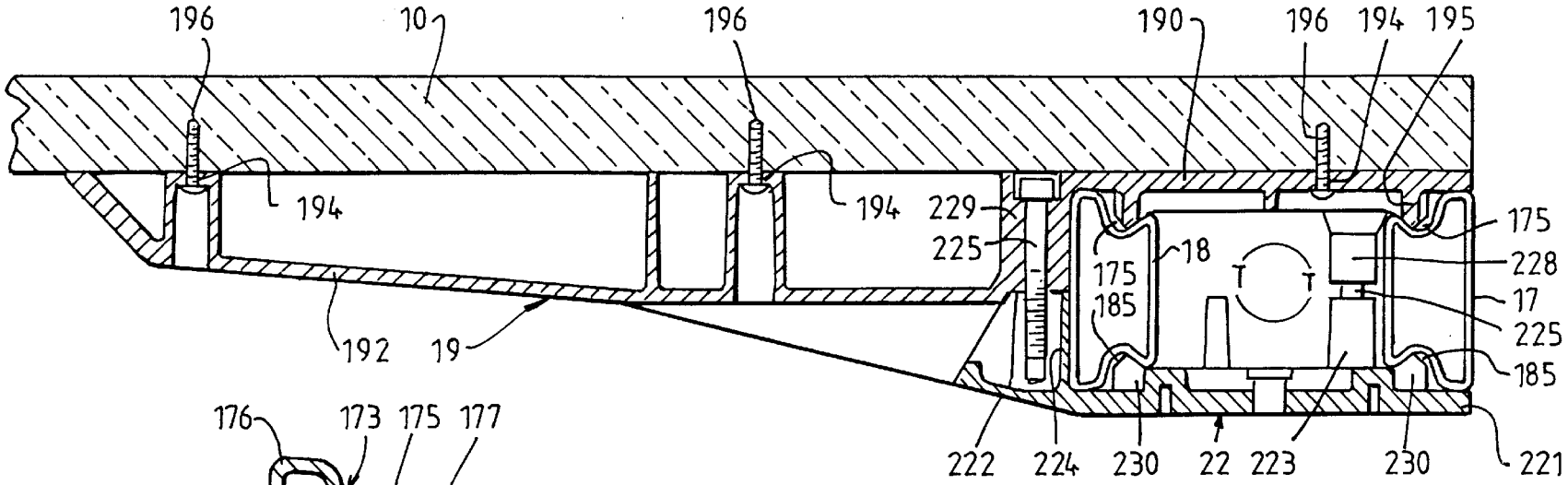
FIG. 34 is an enlarged section through the worktop and support arrangement for the desk FIG. 1.
Figure 35:
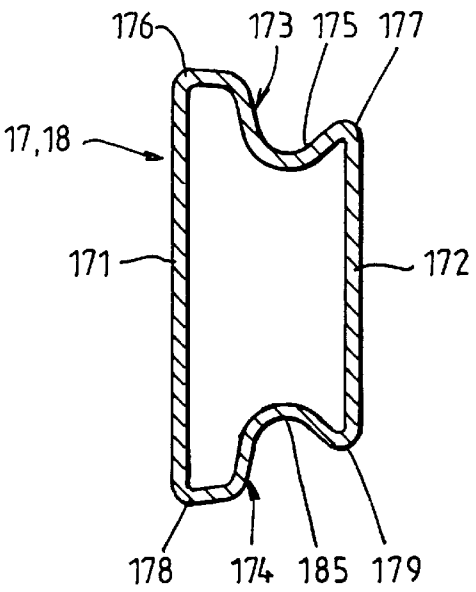
FIG. 35 is an enlarged section through one of the support beams for the worktop.

Referring more particularly to FIGS. 34 and 35, each pair of support beams comprises an outer support beam 17 and an inner support beam 18. The support beams 17, 18 of each pair are disposed at substantially the same horizontal level and extend substantially parallel to each other between adjacent legs 20, 20' of the desk. Each support beam 17, 18 is of hollow form and is preferably made from roll-formed steel. Each support beam 17, 18 has substantially parallel straight sides, 171, 172 which extend substantially vertically in use and upper and lower end portions 173, 174 joining the sides 171, 172.

The upper end portion 173 of each beam 17, 18 is of curved form having a rounded depression 175 between the upper ends 176, 177 of the sides 171, 172 of the beam. The lower end portion 174 of each beam is similarly of curved form having a rounded recess 185 between the lower ends 178, 179 of the sides 171, 172 of the beam. One of the sides 171 of each beam is longer than its opposite side 172 and the beams 17, 18 are spaced apart with their shorter sides 172 facing towards one another.

As shown in FIGS. 1, 34 and 35, the lower surface of the body portion 190 of the support arm 19 has downwardly extending projections 195 which engage in the depressions 175 in the upper end portions 173 of the support beams 17, 18. Similarly, the upper surface of the body portion 221 of the upper leg part 22 has upwardly extending projections 230 which are received in the recesses 185 in the lower end portions 174 of the support beams 17, 18.

The provision of two spaced apart rolled steel support beams 17, 18 which are securely clamped together between the body portions 190, 221 of the support arm 19 and the upper leg part 22 by the fixing bolts 225 provides a strong cantilever support for the worktop 10 secured to the support arm 19. The engagement of the projections 195, 230 of the support arm 19 and upper leg part 22 in the depressions 175 and recesses 185 of the support beams 17, 18 assist in keeping torsional forces (which would normally be exerted on the support arrangement in the direction T shown in FIG. 34) to a minimum.

Whilst the cantilever support arms 19 assist in providing support for the worktop 10, the arrangement of the spaced apart support beams can provide sufficient cantilever support for a desk or worktop without requiring cantilever support arms extending in a horizontal direction from the support beams, as will be described with reference to the modified clamping arrangement at FIGS. 36 to 38 of the drawings.

Figure 36:
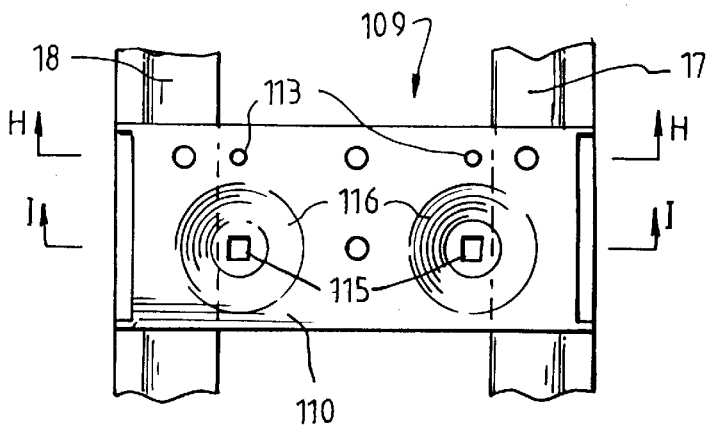
FIG. 36 is a plan view of a modified support arrangement for the worktop.
Figure 37:
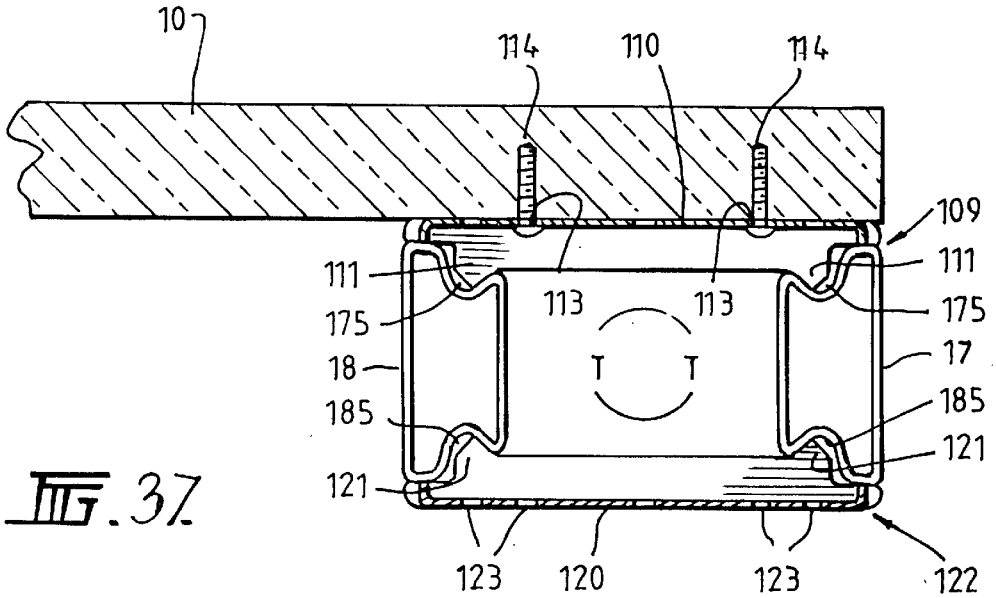
FIG. 37 is a section on the line H—H of FIG. 36.
Figure 38:
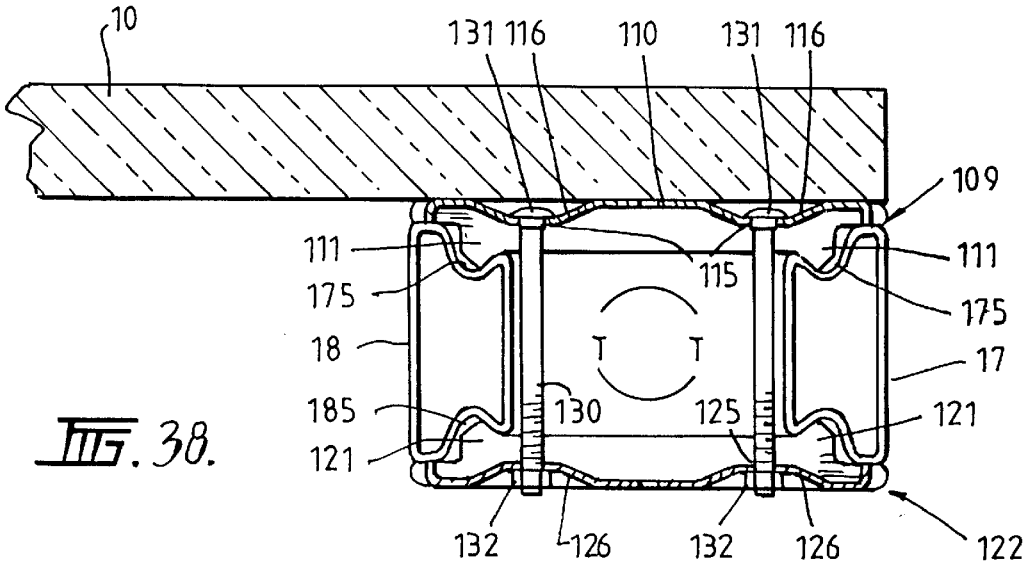
FIG. 38 is a section on the line I—I of FIG. 36.

In the modified clamping arrangement of FIGS. 36 to 38, the spaced apart support beams 17 and 18 are clamped between upper and lower clamping members 109 and 122 which are of similar form to each other. The upper clamping member 109 comprises a clamping plate 110 having projections 111 extending downwardly from its lower surface which engage in the depressions 175 in the upper end portions 173 of the support beams 17, 18. The clamping plate 110 has a plurality of screw holes 113 which receive screws 114 for securing the worktop member 10 to the upper clamping member 109. The clamping plate 110 also has a pair of bolt-receiving holes 115 spaced apart on the central longitudinal axis of the clamping plate 110.

The lower clamping member 122 comprises a clamping plate 120 of similar form to the clamping plate 110 and has projections 121 extending upwardly from its lower surface which engage in the recesses 185 in the lower end portions 174 of the support beams 17, 18.

The lower clamping member 122 also has a pair of bolt-receiving holes 125 extending through the plate 120 at spaced apart locations on the central longitudinal axis of the plate 120. When the lower clamping member 122 is to be secured to the upper end of a supporting leg from the worktop 10, the clamping plate 120 will also be provided with a plurality of bolt or screw holes 123 for receiving bolts or screws for securing the lower clamping member 122 to the upper end of a leg.

As shown in FIGS. 37 and 38, the spaced apart support beams 17.18 are clamped between the upper and lower clamping members 109, 122 by coach bolts 130 extending through the bolt-receiving holes 115 and 125 in the clamping plates 110, 120. The upper and lower clamping plates 110 and 120 preferably have recessed areas 116, 126 surrounding the bolt-receiving holes which are engaged respectively by heads 131 of the bolts 130 and nuts 132 received on the lower end of the bolts 130.

The spaced apart support beams 17, 18 which are securely clamped together between the upper and lower clamping members 109, 122 by the bolts 130 provide a strong cantilever support for the worktop 10 which does not necessarily require cantilever support arms extending horizontally from the support beams. The horizontally extending feet 26 may also be omitted when the clamping arrangement of FIGS. 36 to 38 is used. Also, as in the arrangement of FIGS. 1, 34 and 35, the engagement of the projections 111 and 121 of the clamping members 109, 122 in the depressions 175 and recesses 185 of the support beams 17, 18 assist in keeping torsional forces T to a minimum.

It will be appreciated that various modifications and alterations may be made to the embodiments described herein without departing from the scope and spirit of the present invention.

I claim:

1. A height adjustable leg assembly for a desk, table or workstation having a top member wherein said leg assembly comprises an upper leg part adapted to be fixed relative to the top member, a lower leg part, and at least one removable intermediate leg part adapted to be received between the upper and lower leg parts, wherein the height of the upper leg part relative to the lower leg part is variable by removal of said at least one removable intermediate leg part, the upper and lower leg parts being connected by an elongate adjustable member having a shaft which extends through said at least one removable intermediate leg part, the elongate adjustable member having upper and lower portions releasably coupled to the upper and lower leg parts respectively to retain said at least one removable intermediate leg part in position between said upper and lower leg parts, said at least one removable intermediate leg part having a peripheral side wall and a substantially vertical slot extending inwardly from said side wall, said shaft extending vertically through said slot, whereby said at least one removable intermediate leg part is removable from between said upper and lower leg parts by moving said at least one removable intermediate leg part in a substantially horizontal direction when at least one of the upper and lower portions of the elongate adjustable member is uncoupled from a respective one of said upper and lower leg parts without removal of the elongate adjustable member from the adjustable leg assembly.

2. A height adjustment system for a desk, table or workstation comprising a top member supported by a height adjustable leg in accordance with claim 1.

3. A height adjustable leg assembly according to claim 1 wherein a plurality of removable intermediate leg parts are provided having different heights so that the height of the adjustable leg assembly may be increased or decreased by the interchange of one removable intermediate leg part for another of a different height.

4. A height adjustable leg assembly according to claim 1 wherein the upper portion of the elongate adjustable member comprises an enlarged head and the lower portion of the elongate adjustable member comprises a screw-threaded lower end portion of the shaft.

5. A height adjustable leg assembly according to claim 4 further comprising a top starter member fixed to the upper leg part and a bottom starter member fixed to the lower leg part, wherein the enlarged head of the adjustable member is engageable with an upper surface of the top starter member, the shaft of the adjustable member extends through an aperture in the top starter member and through the slot in said at least one removable intermediate leg part and the screw-threaded lower end portion engages with an internally screw-threaded bore in the bottom starter member.

6. A height adjustable leg assembly according to claim 5 wherein the enlarged head of the adjustable member is adapted to be engaged by an adjustment tool for rotating the shaft relative to the upper, lower and at least one removable intermediate leg parts, and the top starter member has a recess in a side of the top starter member to allow the enlarged head of the adjustable member to be engaged by the adjustment tool.

7. A height adjustable leg assembly according to claim 1 wherein a plurality of removable intermediate leg parts are provided of substantially the same height so that the height of the adjustable leg assembly depends on the number of removable intermediate leg parts included in an assembled leg assembly.

8. A height adjustable leg assembly according to claim 1 further comprising a duct for cabling attached to a lower part of the adjustable leg assembly.

9. A height adjustable leg assembly according to claim 8 wherein the duct comprises a hollow duct member extending vertically alongside the adjustable leg assembly and attached to the lower leg part.

10. A height adjustable leg assembly according to claim 9 wherein the duct for cabling includes at least one outlet socket for power or communications.

11. A height adjustment system for a desk, table or workstation comprising a top member supported by a plurality of height adjustable legs in accordance with claim 1.

12. A height adjustment system according to claim 11 further comprising at least one cable tray extending substantially horizontally between a pair of adjacent legs of the height adjustment system.

13. A height adjustment system according to claim 12 wherein a cover member is attached to the top member at a location above the cable tray.

14. A height adjustment system according to claim 13 wherein the cover member is pivotally connected to an edge of the top member.

15. A height adjustment system according to claim 14 wherein the cover member is movable relative to the top member from a first position in which it extends substantially horizontally outwardly from the top member to a second position allowing access to the cable tray.

16. A height adjustment system according to claim 15 wherein the cover member is pivotally connected to the top member by a pivotal mounting comprising a cover mounting member attached to the top member and a pivot piece having curved limbs received in complementary receiving portions of the cover member and cover mounting member.

17. A height adjustment system according to claim 12 wherein each leg of the height adjustment system has a substantially vertically extending cable duct attached to its lower leg part and the cable tray is secured to the upper ends of the respective ducts of the legs.

18. A height adjustment system according to claim 12 wherein the cable tray includes at least one partition for dividing the tray into compartments for different types of cables.

19. A height adjustment system according to claim 12 wherein the cable tray includes at least one outlet socket for power or communications.

20. A height adjustment system according to claim 11 wherein each height adjustable leg is disposed underneath a side or rear edge of the top member and the top member is supported by at least one generally horizontally extending cantilever member.

21. A height adjustment system according to claim 20 wherein the support beams are clamped between upper and lower clamping members.

22. A desk, table or workstation according to claim 21 wherein the upper and lower clamping members have projections or recesses which engage with complementary recesses or projections in the support beams.

23. A height adjustment system according to claim 22 wherein the support beams are of hollow form having substantially vertical straight sides and upper and lower end portions with recesses or depressions therein for engagement by complementary formations on the upper and lower clamping members.

24. A height adjustment system according to claim 21 wherein the upper and lower clamping members are secured together with at least one support beam clamped therebetween by securing means.

25. A height adjustment system according to claim 21 wherein the lower clamping members are secured to upper leg parts of the legs.

26. A height adjustment system according to claim 21 wherein the upper clamping members are secured to the top member.

27. A height adjustment system according to claim 26 wherein the upper clamping members comprise cantilever support arms extending substantially horizontally from the support beams.

28. A height adjustment system according to claim 21 wherein the lower clamping members constitute the upper leg parts of the legs.

29. A height adjustment system according to claim 20 wherein a pair of spaced apart support beams extend between adjacent pairs of legs, the pair or support beams being disposed at substantially the same horizontal level and extending substantially parallel to one another.

30. A height adjustment system according to claim 20 wherein the support beams are clamped between upper and lower clamping members provided at locations between the legs.

31. A height adjustment system according to claim 20 wherein the support beams are formed from roll-formed steel.

* * * * *

UNITED STATES PATENT AND TRADEMARK OFFICE

CERTIFICATE OF CORRECTION

PATENT NO. : 6,029,586
DATED : February 29, 2000
INVENTOR(S) : A. Schiavello

It is certified that error appears in the above-identified patent and that said Letters Patent is hereby corrected as shown below:

Title page,
Item [75], Inventor "Templestowe, Wash." should read -- Templestowe, Victoria, Australia --
Item [56], References Cited, U.S. PATENT DOCUMENTS, insert the following references in the appropriate numerical order:

| | | |
|---|---|---|
| -- 321,907 | 7/1885 | Mitchell |
| 3,232,253 | 2/1966 | Winters |
| 4,094,256 | 9/1978 | Holper et al. -- |

Item [57], ABSTRACT,
Line 5, "The or each" should read -- Each --

Column 12,
Line 25, "desk, table or workstation" should read -- height adjustment system --
Line 54, "pair or" should read -- pair of --

Signed and Sealed this

Twenty-second Day of October, 2002

*Attest:*

*Attesting Officer*

JAMES E. ROGAN
*Director of the United States Patent and Trademark Office*